United States Patent [19]

Langston

[11] Patent Number: 4,758,245

[45] Date of Patent: Jul. 19, 1988

[54] APPARATUS FOR STARTING FIRES AND METHOD FOR MAKING AND USING SAID APPARATUS

[76] Inventor: Harold L. Langston, 7015 Reno Hwy., Fallon, Nev. 89406

[21] Appl. No.: 12,054

[22] Filed: Feb. 6, 1987

[51] Int. Cl.[4] ..... C10L 11/08

[52] U.S. Cl. ..... 44/11

[58] Field of Search ..... 44/38, 41, 2, 11–14, 44/1 E, 10 B; 100/110

[56] References Cited

U.S. PATENT DOCUMENTS

| | | | |
|---|---|---|---|
| 79,903 | 7/1868 | Gaudin et al. | 44/10 B |
| 149,436 | 4/1874 | Bynon | 44/10 B |
| 584,104 | 6/1897 | Brissett | 44/10 B |
| 2,107,054 | 2/1938 | Haymond | 44/41 |

FOREIGN PATENT DOCUMENTS

| | | | |
|---|---|---|---|
| 1154594 | 10/1983 | Canada | 44/1 E |
| 1445736 | 8/1976 | United Kingdom | 44/12 |

*Primary Examiner*—Carl F. Dees

*Attorney, Agent, or Firm*—Herbert C. Schulze

[57] ABSTRACT

This is a starter for starting fires comprising a block of sawdust impregnated with paraffine and having a wick extending therethrough which block is made by filling a mold with sawdust, pouring liquid paraffine into said mold onto and throughout said sawdust, compressing said mixture of sawdust and paraffine, removing excess paraffine therefrom, forming an opening through the compressed mixture, inserting a wick therethrough, and subsequently igniting the wick, resulting in the compressed sawdust and paraffine mixture burning throughout its thickness from the area around the wick outwardly to its perimeter.

1 Claim, 3 Drawing Sheets

FIG. 11.
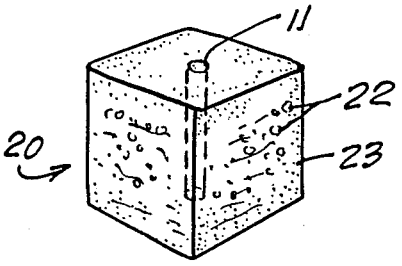
FIG. 12.
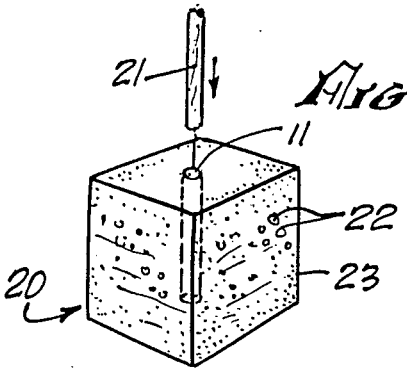
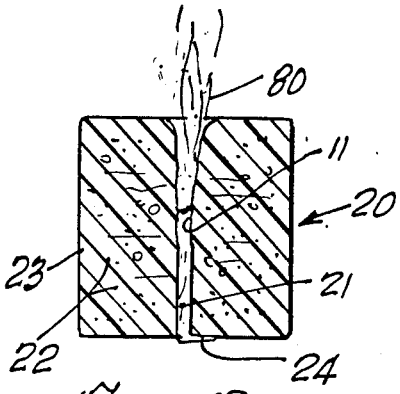
FIG. 13.
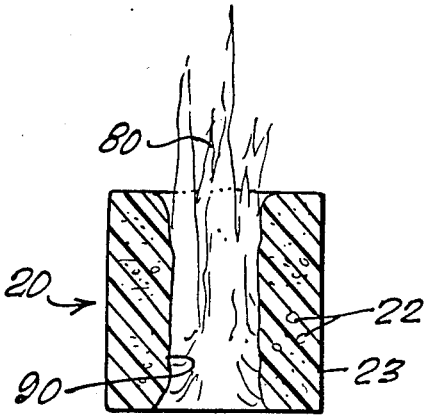
FIG. 14.
FIG. 15.
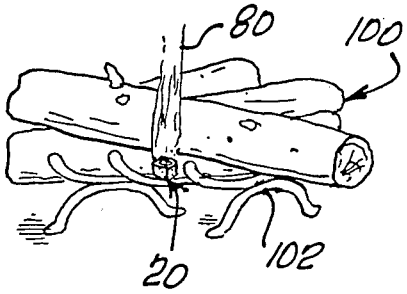
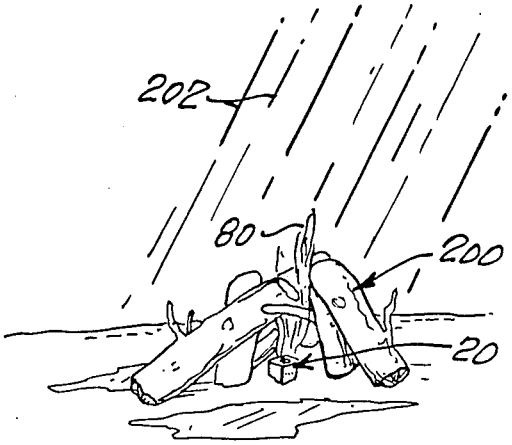
FIG. 16.

APPARATUS FOR STARTING FIRES AND METHOD FOR MAKING AND USING SAID APPARATUS

CROSS REFERENCE TO RELATED PATENT APPLICATIONS

There are no patent applications related to this application filed by me.

BACKGROUND OF THE INVENTION

I. Field of the Invention

This invention is in the general field of apparatus for igniting combustible material; the invention is even more particularly in the field of an apparatus for igniting combustible material wherein a combination of paraffine and sawdust is utilized; the invention is even more particularly directed to an apparatus and method for making and using the same wherein a block of paraffine and sawdust mixture contains a wick running therethrough, and is even more particularly directed to such an apparatus and method for making and using the same wherein when the wick is ignited it burns through the thickness of the paraffine and sawdust mixture and then burns outwardly to the perimeter from about the wick.

II. Description of the Prior Art

Certain types of waxes and the like, including paraffine, have been used in the past as candles and for other purposes, even including ignition purposes for other combustible material.

However, I have no knowledge of any prior art wherein sawdust and paraffine are compressed into a solid block of material having a wick running through its entire thickness, which wick, when ignited, burns through the mixture and then causes the entire sawdust and paraffine mixture to be consumed by combustion outwardly in a uniform manner from around the area of the wick to the exterior perimeter of the paraffine and sawdust mixture. Likewise I have no knowledge of a method for making such an apparatus in a manner as hereinafter described nor in using it in the manner hereinafter described.

SUMMARY OF THE INVENTION

There are numerous conditions under which it is desired to ignite combustible material such as wood used in fireplaces, stoves, campfires and the like, or coal and other such materials used for various purposes, frequently for purposes of heating, cooking, performing industrial operations, and the like.

It is well known that it is difficult to cause suitable ignition in large pieces of wood or the like, such as logs. In general it becomes necessary to use a combination of materials to accomplish this, most commonly considerable paper, shavings, small pieces of wood known as kindling, and the like.

It is common to lay in the materials for a fire in a wood stove, fireplace, or campfire, by building a structure usually of some material to maintain the other materials at a distance from the base of the area in which the fire is desired and then to construct a structure comprising considerable paper, crisscrossed numerous pieces of small or kindling wood; some medium sized pieces of wood materials, with a large log or logs at the very top. The paper will then normally be ignited with a match or the like, and after burning for a period of time will ignite the kindling which in turn will ignite some of the smaller pieces of wood, and thus a fire gradually begins to build a sufficient intensity to cause combustion in the larger and more dense pieces of wood or the like.

Disadvantages of the customary method of building a fire of this nature include the tedious nature of arranging the materials and also the rather large amount of unsightly ash and blackened burned newspaper and the like which will result. Particularly if this is accomplished within a dwelling room, there may be large pieces of blackened paper which will soil rugs, upholstered furniture, and the like.

There are available some ignition aids, such as specially constructed sticks of compositions which will theoretically burn well, ignition fluids, and the like. Each of these ignition aids has its purposes and yet each fails to completely correct the problem being sought to be corrected by me with this present invention.

Many of the materials used in ignition aids are toxic and sometimes explosive or otherwise dangerous.

On studying the entire problem over a considerable period of time, I conceived an ignition aid, or starter for fires which eliminates all of the disadvantages of any other method and completely eliminates the necessity of having to use excessive material such as paper and the like in order to achieve the required ignition.

I have found that a densely compressed mixture of sawdust and paraffine, if properly ignited itself, will burn for a long period of time and with an intense flame. I have further found that by igniting this item by use of a wick extending through a block of such material the material will burn from around the wick through its thickness and outwardly creating a flue, which enhances the flame by reason of the draft created throughout its thickness as will be better understood in connection with the description of a preferred embodiment which follows.

In creating this item I fill a suitable mold having four sides a top and a bottom and a movable immediate plate having pegs attached thereto with sawdust. Thereafter I pour appropriate amount of liquid paraffine into the mold where it works its way through the sawdust.

When the mold is filled in this manner, the top is then secured and the movable plate is moved by means such as are described in the description of a preferred embodiment so as to compress the sawdust and paraffine mixture. Provision is allowed for excess paraffine to drain off.

When the compression is complete, the top may be removed from the mold and the block of compressed paraffine and sawdust having nummerous holes caused by the pegs on the movable block, will be removed.

Thereafter, I cut the block into smaller blocks such that each block contains in its center a hole into which a wick consisting of string impregnated with paraffine may be inserted.

After the blocks have been cut, the wick is so inserted and is held in place adjacent one end of the hole by melted paraffine and extends upwardly out of the other end of the hole a sufficient distance to allow proper lighting.

There is sufficient clearance where the wick fits within the hole that when the wick is lighted, it quickly burns all the way through the thickness of the block of compressed sawdust and paraffine and thus creates a burning flue in the center of the block of material. This flue creates an intense flame which will then ignite virtually anything, ignitable, under which it has been placed.

The flame is so intense that it will work in rain and damp conditions as well as ordinary normal conditions.

A block can be constructed to burn for whatever length of time may be desired and in general a block approximately 1 inch by 1 inch by 1 inch will burn for about 20 minutes allowing ample ignition of the larger logs and the like which are being used for the basic fire.

It is an object of this invention to form a compressed block of sawdust and paraffine containing a wick, suitable to ignite other materials;

Another object of this invention is to provide such an item as has been described wherein it is non-toxic and non-explosive;

Another object of this invention is to provide an item as described wherein a multiplicity of such items may be formed economically;

Another object of this invention is to provide a method for forming such an item as described by compressing the material in a mold, simultaneously forming an opening into which a wick may be inserted.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 11 is a perspective view of an individual block of the material with the hole for the wick being shown;

FIG. 12 illustrates the insertion of the wick into the block;

FIG. 13 is a sectionalized view of the block of material wherein the wick has started to burn;

FIG. 14 is a view similar to FIG. 13 but showing how the material burns outwardly creating a flue and intense flame;

FIG. 15 illustrates the apparatus of this invention being used in a fireplace or the like; and FIG. 16 illustrates the apparatus for starting fires being used in adverse weather conditions outside for a campfire.

DESCRIPTION OF A PREFERRED EMBODIMENT

Figure 1:
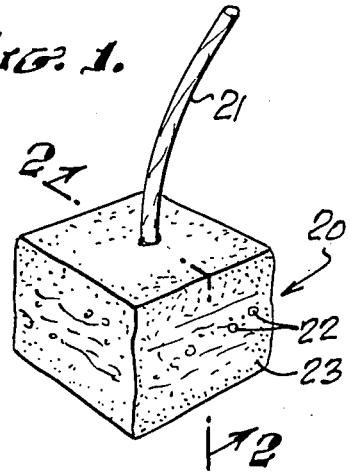
FIG. 1 illustrates an apparatus for starting fires formed and to be used in accordance with the methods of this invention.

FIG. 1 illustrates an apparatus, generally 20 for starting fires in accordance with this invention showing a wick 21 penetrating a compressed block of sawdust 22 and paraffine 23.

Figure 2:
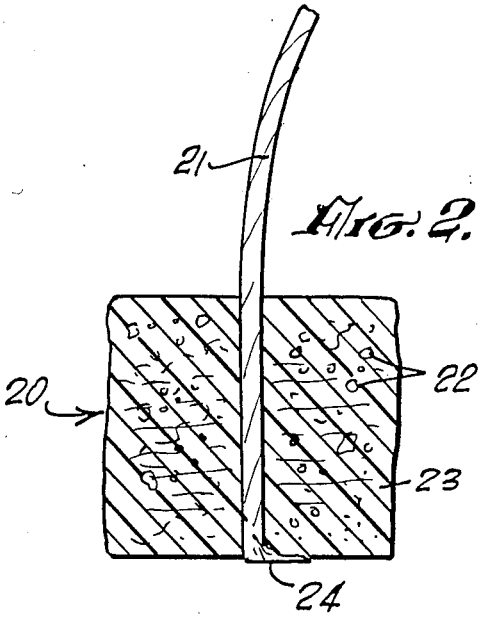
FIG. 2 is a section on 2—2 of FIG. 1.

FIG. 2 shows the method in which the wick 21 penetrates throughout the entire block 20 and is then held in place at the bottom by being slightly bent over 24 and being melted with paraffine so as to stay in place. The wick 21 will be loosely fitting generally in the hole which hole is better illustrated in FIGS. 11 and 12. In those figures it is identified by the numeral 11.

Figure 7:
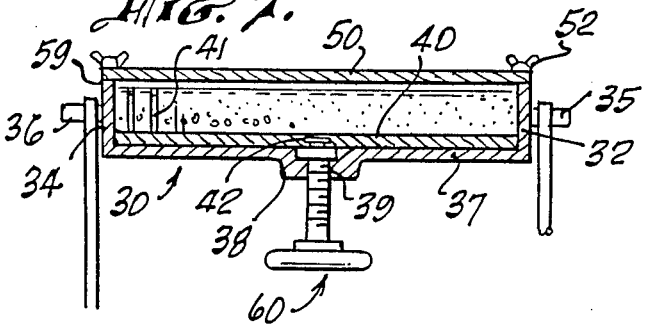
FIG. 7 is a figure similar to FIG. 6 showing the mold filled with sawdust and paraffine and the top in place ready for compression.
Figure 8:
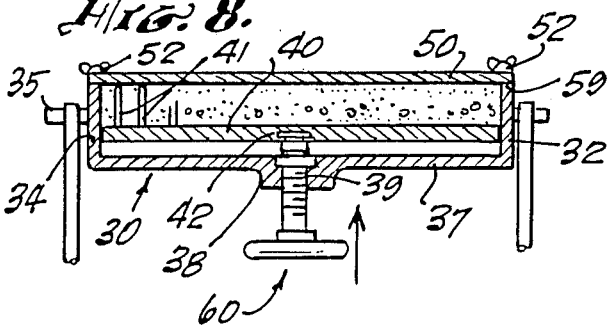
FIG. 8 is a view similar to FIG. 7 in which compression of the movable plate has started.
Figure 9:
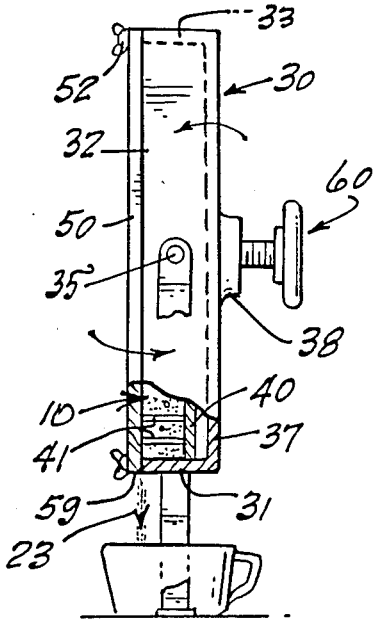
FIG. 9 shows the actual directional alignment as 90 degrees different from the alignment when the material was being placed within the mold and 90 degrees different from FIG. 8, wherein the item has been turned on its axle so that excess paraffine will drain into a proper drainage container during final compression.

FIGS. 3, 4, 5, 6, 7, 8 and 9 should be viewed together since they show all of the elements of the apparatus to form the apparatus for starting fires and in addition shows the various operations. By looking at all of these figures it will be seen that the mold generally 30 has four sides 31, 32, 33, and 34 with an axle 35 on side 32 and an axle 36 on side 34. These axles are appropriately journaled in upstanding support members to enable the mold to be rotated 90 degrees as is illustrated in FIG. 9. The axles 35 and 36 will be appropriately journaled in the upstanding members 70 which will be affixed to a base in a manner known to those skilled in the art.

The bottom of the mold, 37, will have appropriate boss or the like 38 to provide threads cooperating with threads 39 on the movable member 60 which is used to move the movable plate 40 upward when desired.

Figure 5:
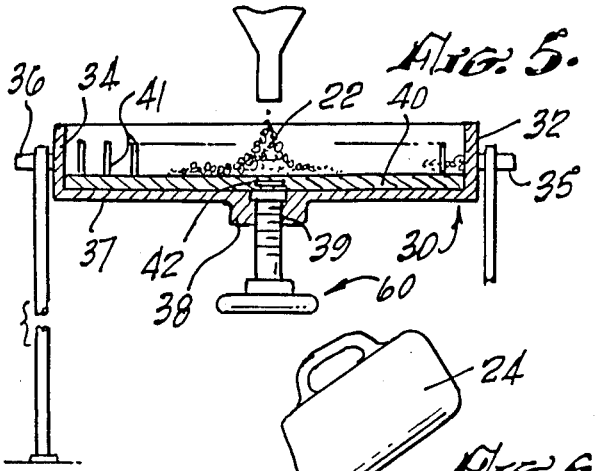
FIG. 5 is a sectionalized view of a preferred apparatus for forming the apparatus for starting fires in section, and with the top removed and showing sawdust being injected into the mold.
Figure 6:
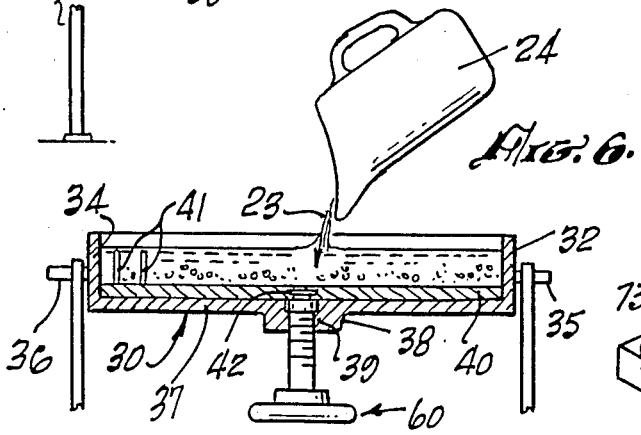
FIG. 6 is a partially sectioned view similar to FIG. 5 but showing paraffine being poured on top of the sawdust in the mold.
Figure 10:
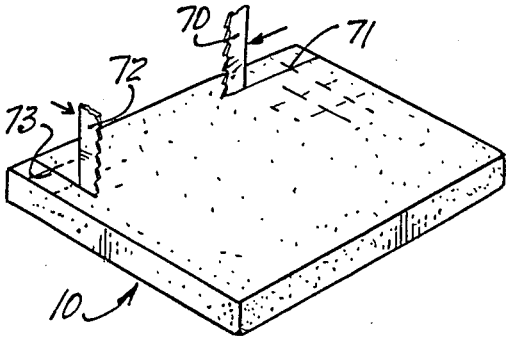
FIG. 10 illustrates a manner of cutting the material so that it is cut into individual blocks.

At the commencement of the operation, the plate 40 having numerous pegs 41 to provide the wick holes, will be filled with sawdust through any appropriate means such as a pipe, funnel or the like as is shown in FIG. 5. When it has been appropriately filled to a position somewhat less than the full thickness of the mold 30, the paraffine 23 will be poured in until the sawdust is fully saturated.

At that point, and as shown in FIG. 7, the top 50 will be applied and held in position by bolts or the like 52 which will be inserted into appropriate threaded holes or the like **52*a***.

The threaded shaft 39 will be appropriately pushed by an independent floating collar or the like 42 so that when the handle 60 is turned, the plate will move forward as shown in FIG. 8. During this operation, as previously mentioned, the mold will be tilted through 90 degrees so that excess paraffine as at 23 in FIG. 9 will drain into a container or the like for reuse.

There will be sufficient space provided at 59 where the cover fastens to the mold to enable the paraffine to drain through.

Figure 4:
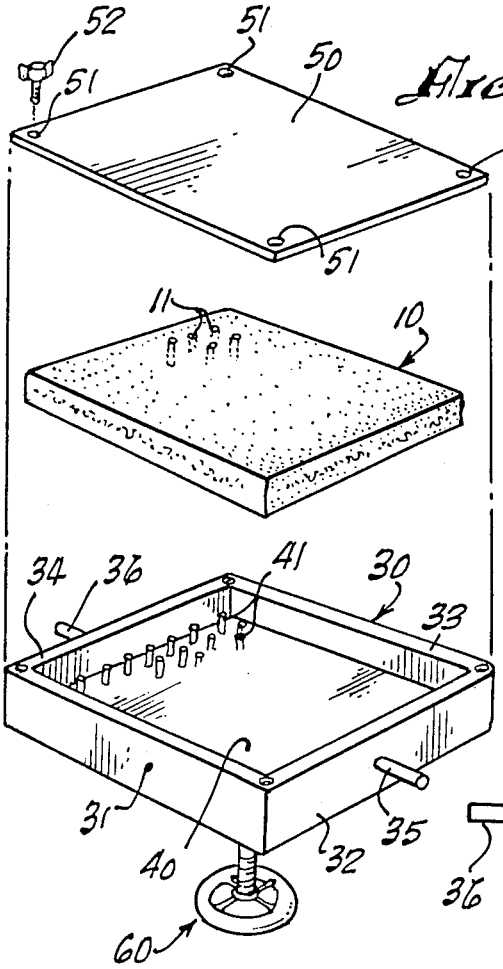
FIG. 4 is an exploded view of the apparatus of FIG. 3 showing the block which has been formed as it is ejected from the mold.
Figure 3:
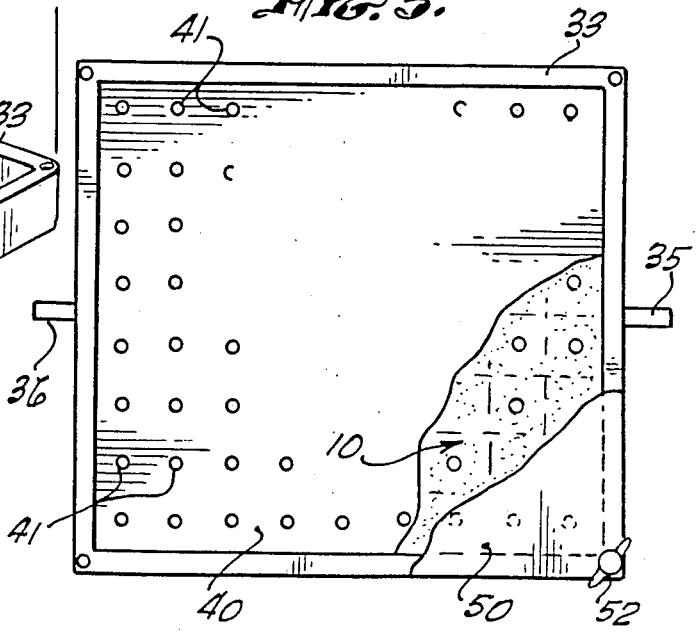
FIG. 3 is a partially broken away top plan view of a mold showing a portion of the top in place and showing the movable plate used in the method of this invention.

After the top has been removed as shown particularly in FIG. 4, the basic block 10 of compressed paraffine and sawdust will exist. There will be holes throughout the block at whatever spacings are desired and as shown at 11 in FIG. 4.

The block will then be cut in two directions as at 71 by saw 70 and at 73 by saw 72. When all of the cuts have been made in both directions, a series of square (or other shape if desired) blocks such as shown in FIG. 11 will exist. A wick 21, comprising string impregnated with paraffine will then be inserted through the hole 11 and will be sealed as previously stated and as shown in FIG. 2 at 24 to the bottom to hold it in place.

When it is ignited, because it is not a solid part of the block itself, the wick will burn all the way through its length and ignite the block 20. The commencement of such flame is shown at FIG. 13 as 80. The flame 80 then rapidly expands outwardly in the direction 90 throughout the thickness of the block 20 creating a very intense draft fire. This will continue to burn for a given period time depending upon the size of the block, but a 1 inch by 1 inch by 1 inch block will normally burn for about 20 minutes giving ample time to start a fire.

As shown at FIG. 15 a block in use has created flame 80 which is not igniting logs 100.

As shown in FIG. 16, even under rainy conditions 202, the flame from this apparatus will ignite even a campfire of wood 200 as indicated.

While the embodiment of this invention as shown and described, is fully capable of achieving the objects and advantages desired, it is to be understood that such embodiment is shown for purposes of illustration only and not for purposes of limitation.

I claim:

1. Apparatus for forming a mixture of sawdust and paraffine into a compressed and combustible block of material comprising a mold box consisting of a bottom fastened to four sides defining a rectangular opening; a plate carrying at least one peg in an upright position thereon loosely laying against the bottom of said box, means cooperative with the bottom of said box suitable to force the loosely fitting plate upward in the box; a cover removably fastenable to the top edge of the sides of said rectangular box; a pair of axles depending outwardly from the approximate center of two opposed sides of said box, means to support said axles so said box may be rotated 90 degrees thereon; and means to provide drainage between the top of said box and at least one edge thereof in order to allow drainage of a liquid material therefrom.

* * * * *